United States Patent [19]

Mayer

[11] 4,306,234

[45] Dec. 15, 1981

[54] X-Y SERIAL SHIFT PANEL

[75] Inventor: William N. Mayer, White Bear Lake, Minn.

[73] Assignee: Modern Controls, Inc., Elk River, Minn.

[21] Appl. No.: 146,664

[22] Filed: May 5, 1980

[51] Int. Cl.[3] ..... H05B 37/00

[52] U.S. Cl. ..... 340/769; 313/216; 313/217; 315/169.2; 340/758; 340/779

[58] Field of Search ..... 340/758, 769; 315/169.2; 313/216, 217

[56] References Cited

U.S. PATENT DOCUMENTS

| | | | |
|---|---|---|---|
| 3,781,600 | 12/1973 | Coleman et al. | 340/758 |
| 3,944,875 | 3/1976 | Owaki et al. | 340/769 |
| 3,995,185 | 11/1976 | Miller | 313/217 |
| 4,039,881 | 8/1977 | Le Coquil et al. | 313/217 |
| 4,247,802 | 1/1981 | Kurokawa | 315/169.2 |

OTHER PUBLICATIONS

Beidl, Campagna, Criscimagna, Single-Sided Shift Panel, IBM Tech. Discl. Bul., vol. 20, No. 11A, Apr. 1978, pp. 4469–4470.

*Primary Examiner*—David L. Trafton
*Attorney, Agent, or Firm*—Paul L. Sjoquist

[57] ABSTRACT

Apparatus for providing a visual information screen by means of a plurality of gas cells serially arranged along gas channels within a glass panel, having orthogonal parallel conductors in dielectric separation over the channels, wherein a single electrical input circuit is utilized to ignite a gas cell which may be serially shifted to selected gas channels and subsequently parallel shifted with other similar gas cells along the channels by electrical excitation of the conductors.

15 Claims, 12 Drawing Figures

X-Y SERIAL SHIFT PANEL

BACKGROUND OF THE INVENTION

This invention relates to visual display devices, and more particularly to display devices constructed from flat glass panels having gas channels therein and electrical conductors in dielectric separation from the gas in the channels. Voltage excitation of selected conductors causes gaseous ignition and such ignition may be selectively shifted by properly sequencing voltage pulses to adjacent conductors within the panel.

This invention relates to U.S. Pat. No. 4,080,597, issued Mar. 21, 1978, wherein a particular conductor geometry is disclosed for initially igniting a gas cell or cells at an input terminal to the display panel, which geometry enables cell ignition to be accomplished at the same voltage as is required to sustain ignition in other gas cells within the display panel. The aforesaid patent discloses a row of pilot cells arranged along an edge of the display panel to constantly provide a source of gaseous ignition to each of the plurality of channels within the panel, which gaseous ignition is time-shifted into respective adjacent cells in the gas channels through the application of sequential timing voltages to adjacent parallel conductors. Each gas channel within the display panel utilizes an input conductor geometry of the type disclosed for initial cell ignition at a channel input, and the sequential timing sequence enables all ignited cells to shift in parallel along their respective gas channels throughout the panel itself. The present invention is an improvement over the aforementioned patent in that it permits a plurality of gas channels to be initially excited by a single input conductor rather than requiring a plurality of conductors for the respective gas channels.

SUMMARY OF THE INVENTION

The present invention includes a gas display panel having a plurality of parallel gas channels and a plurality of orthogonally aligned conductors in dielectric separation from the gas channels. An input end into each gas channel is geometrically arranged with conductor segments in dielectric separation thereto, each of the conductor segments having a voltage applied thereto in a preferred excitation sequence; an orthogonal gas channel is positioned adjacent the respective open ends of each of the gas channels, the orthogonal channel having conductor segments in dielectric separation thereto, and having an input conductor geometry positioned at one end thereof. A voltage sequence is arranged such that the input conductor geometry is energized and the selected conductor tabs are sequentially energized to propagate a gaseous ignition region along the orthogonal channel until the gaseous ignition region has been shifted into position adjacent the ends of all channels for which a gas cell is desired to be ignited. The ignition of these selected gas cells may then be shifted in parallel through the parallel gas channels to move a selected line of gaseous ignition regions into the panel. A particular gas display panel may have one or several such configurations, to create a gas display panel which effectively utilizes the shifting of gas ignition cells in serial and in parallel format.

BRIEF DESCRIPTION OF THE DRAWINGS

A preferred embodiment of the invention is disclosed herein, and with reference to the drawings, in which.

DESCRIPTION OF THE PREFERRED EMBODIMENT

Figure 1:
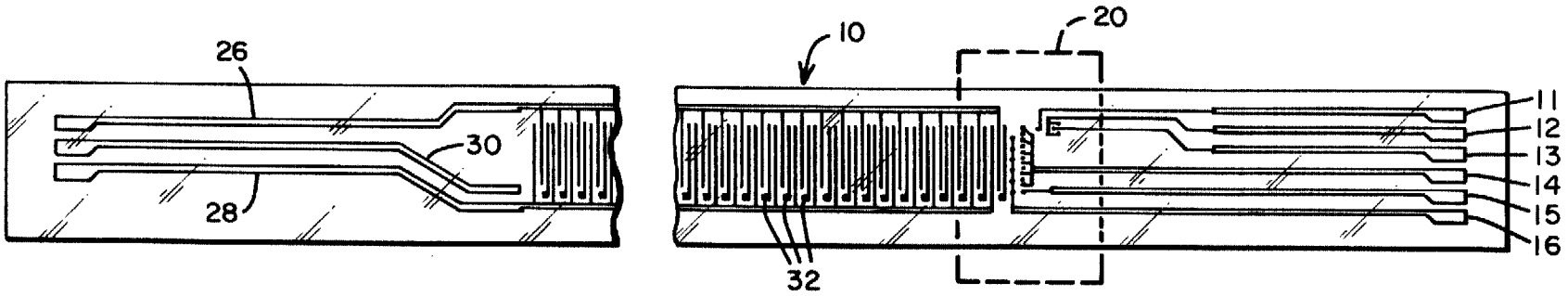
FIG. 1 shows a partial top view of a display panel incorporating the invention.

Referring first to FIG. 1, a partial top view is shown of a gas display panel 10 of the type incorporating the present invention. Display panel 10 is constructed from glass layers, some of which have conductor segments deposited thereon, and others have voids etched therein, such that when the layers are sealed together a gaseous mixture may be introduced into the voids to be disbursed throughout the voids and electrical voltages may be applied to the conductors for voltage energization. All conductor segments are electrically coupled to conductive pads which are located adjacent the ends of the gas display panel, as for example pads 11, 12, . . . 16 and other similar pads at the other end of the gas display panel. Conductor segments 26, 28, and 30 connect to such end pads and are respectively electrically connected to a plurality of internal conductor lines within the glass panel. Some of the interconnecting conductor segments and lines have been omitted in FIG. 1 for purposes of clarity. For example, conductor segment 30 actually makes electrical contact with a plurality of tabs 32, each of which are formed from raised posts to permit the electrical connections to be made at an elevated planar level; these connections are not shown on FIG. 1. Similarly, some of the electrical connections to the plurality of pads in the input region, designated by dotted outline 20, are not shown in FIG. 1.

For convenience herein, all internal conductor lines which are electrically connected to conductor segment 26 will be denoted as "A" lines herein; all internal electrical conductor lines which are electrically connected to conductor segment 28 will be denoted as "B" lines herein; all internal electrical lines which are electrically connected to conductor segment 30 will be denoted as "S" lines herein. Other alphabetic designations will be applied to conductor segments and lines hereinafter.

The display panel of FIG. 1 has therein a plurality of gas channels which run generally parallel to conductor segments 26, 28 and 30, and orthogonal to the plurality of smaller vertical conductor segments, such as conductors 32. The display panel may be made of any convenient size, the embodiment shown in FIG. 1 being relatively long and narrow and having therein from six—nine gas channels for the display of a single alphanumeric line of characters. In this embodiment, the display panel has approximate dimensions of 2 inch × 12 inches, although any other convenient dimensions are equally possible.

The dotted outline portion 20 of FIG. 1 denotes the input conductor region of the gas panel. All of the gas channels originate in this region and extend leftward across the panel in parallel configuration. The input display information is electrically input into the panel via conductor line 13 in the form of a digital binary voltage signal. The electrical conductors in this region, to be described hereinafter, respond to the input signal on line 13 to create a spot or "cell" of gaseous ignition and to shift the ignited cell along the various gas channels according to a preselected timing scheme, and therefore to construct a visual display of an alphanumeric character through the proper combination of a plurality of such ignited gas cells. The digital binary information input at line 13 is synchronized with the internal electrical timing such that digital signals are input in a timed serial format in order to develop the display information. All of the timed signals coupled into the display panel are connected to the conductor pads at the respective ends of the display panel.

Figure 2:
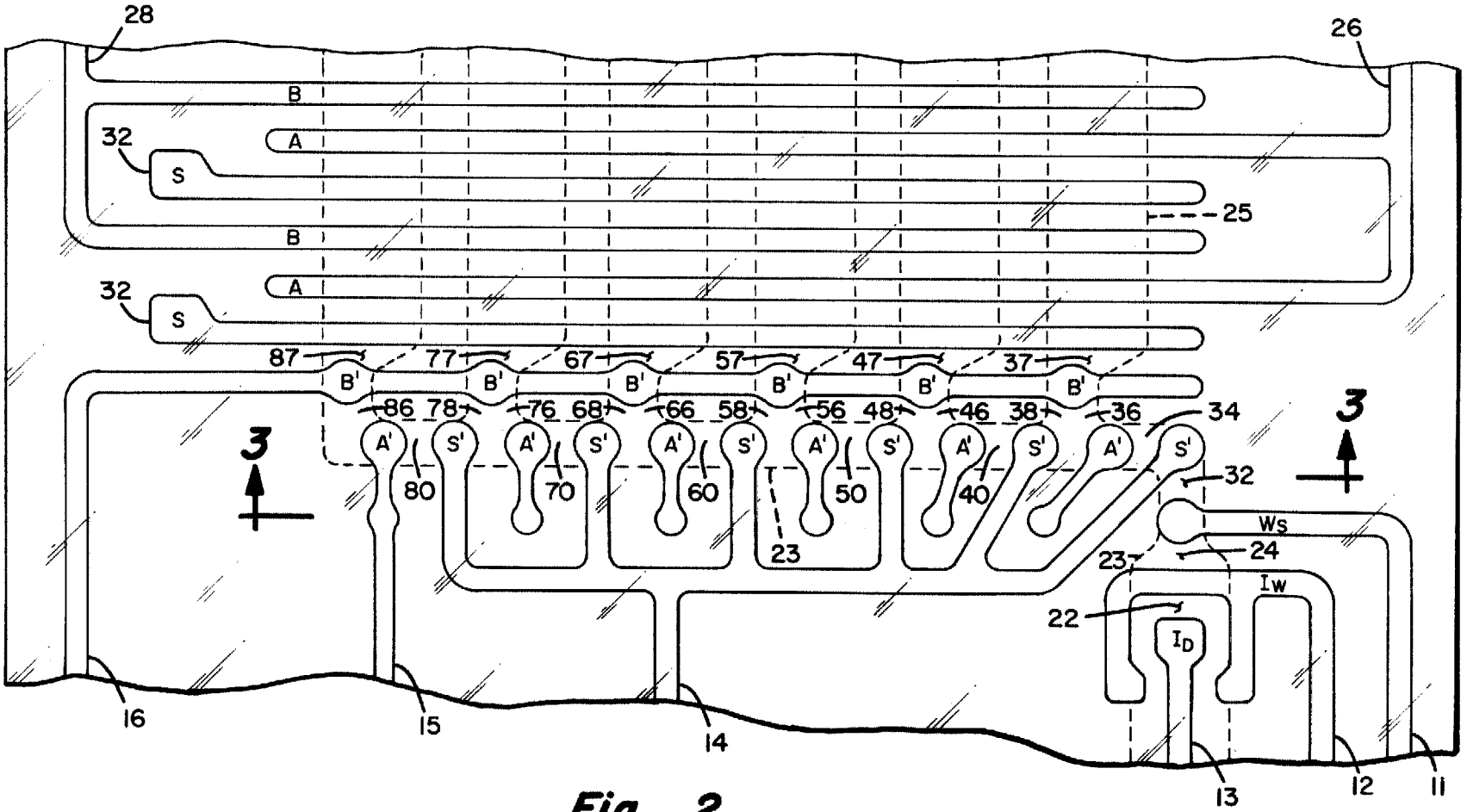
FIG. 2 is an expanded view of a portion of the display panel.

FIG. 2 shows an expanded view of a portion of the input conductor region 20. Gas channels are shown in dotted outline format, as for example gas channel 25. A single input conductor line 13, designated the $I_D$ line, receives digital binary signals from a keyboard or computer or other digital device in serial time format. These signals are represented by one of two voltage levels which are applied to the $I_D$ line. Input line 12 receives timed $I_W$ signals, which signals interact with the $I_D$ signals to cause a gaseous ignition in region 22 of channel 23. Subsequently, a timed electrical signal ($W_s$) is applied to input line 11 and the $W_S$ signal applied thereby interacts with the $I_W$ signal to create a gaseous ignition in the region 24 of channel 23. In the meantime, the gaseous ignition in region 22 extinguishes or reignites, as the case may be, depending upon the relative $I_W$ and $I_D$ signals at subsequent time intervals. It is to be appreciated that all of the conductors, lines, and conductor segments referred to herein are electrically isolated from direct electrical communication with the gas channels, there being a thin glass dielectric layer between the conductor elements and the gas channels. Preferably the conductors are embedded in the glass panel and the gas channels themselves are created in voids traversing a glass layer positioned immediately above the glass layer in which conductors are embedded.

No physical barriers are placed between adjacent regions or cells in each of the channels, the regions or cells being produced solely by electrical signal interaction between adjacent conductors, in combination with the capacitive voltage effects created by the dielectric separation between conductors and the gas channel. However, adjacent channels are separated by a thin glas wall, which provides a physical isolation of the respective gas mixtures of the channels, except in the input conductor region 20. In region 20 all gas channels are brought into common gaseous communication with channel 23. Thus when a gas region or a cell in a channel is referred to herein, it is intended to infer no definitive geometrical parameters beyond the general spatial region intermediate a pair of conductors which have voltages applied thereto. Gaseous ignition can "travel" from cell to adjacent cell in a channel by merely regulating the respective voltage potentials applied to conductors in adjacent positions along the channels.

The relative spacing and size of the conductor elements shown in FIG. 2 are important to the proper operation of the invention. The cross-sectional areas of each of the conductor elements which are in bridging relationship to the respective gas channels should be substantially equal. The spacing between adjacent conductors which lie in the path along which gaseous ignition is propagated should be substantially identical. For example, the inter-conductor spacing in the regions designated as 22, 24, 32, 34, 36, 38, 40, 46, 48, . . . 86 should be substantially identical, and should also be the same as the inter-conductor spacing designated as 37, 47, 57, . . . 87. The cross-sectional areas of the conductor segments bridging the gas channels for those conductors designated as S, A, B, . . . should be substantially identical to the cross-sectional areas of the conductor pads designated as S', A', B' . . .

In the preferred embodiment the parallel gas channels are located along 15-mil (0.015 inch) centerlines, with the respective channels being separated by about a 5-mil glass wall. Channel 23 is about 5-mils in width, which is substantially equal to the width of the respective ends of the parallel channels at the junctions where they join channel 23. The cross sectional areas of the conductor segments which bridge the various channels is about 20 square mils, and the conductor-to-conductor centerline distance of the parallel S, A, B, conductors is about 5-mils. Of course, all of these dimensions may be proportionately varied to create other embodiments and relative dimensions and areas may depart somewhat from the preferred relationships described herein. It has been found that the relative dimensions are fairly critical when the apparatus is operated at any specific voltage signal level, but adjustment of the respective voltage signal levels may permit some departure from the relative dimensions and areas described above. It has been found preferable to operate the apparatus at a voltage signal level in the range of 150–300 volts, and good operating results have been achieved with the preferred embodiment described herein with voltage signals in the range of 230–280 volts.

Gaseous ignition in region 24 is moved into region 32 by selective voltage energization of input lines 11 and 14, which causes voltage interaction between the $W_S$ and the S' conductors. Similarly, voltages applied to input lines 14 and 15 causes interaction between the A' and S' conductors and permits a gaseous ignition in region 32 to move into a region (cell) 34. Likewise the gaseous ignition may be transported into regions 36 and 38 by proper energization of lines 15 and 16 (A' and B') and lines 16 and 14 (B' and S'), and the gaseous ignition may be propagated horizontally along gas channel 23 by subsequent voltage energization of the A', B', S' conductors in proper sequence, to provide propagation through the cell regions according to the cell pattern 36, 38, 40; 46, 48, 50; 56, 58, 60; 66, 68, 70; 76, 78, 80; and 86. The propagation of gaseous ignition over the cells depends upon the timed voltages initially applied to input line 13, and under typical operating conditions the respective cells are intermittently ignited and nonignited according to the serial signal input at line 13. Thus, if the timed pattern of signals at line 13 calls for a pattern of "on" and "off" signals, this signal pattern propagates along the cells described above in spatial serial correlation with the timed serial signals applied to line 13 ($I_D$). Examining the operation in another way, a particular input signal on line 13, whether it be an "on" or "off" signal, will be physically propagated over the cell pattern until eventually it arrives at cell 86 near the end of channel 23. At this instant the relative "on" or "off" conditions of cells 76, 66, 56, 46, and 36 will be determined by the subsequent $I_D$ signals applied after the initial $I_D$ signal.

At any instant of time the cell conditions at cells 36, 46, 56, . . . can be respectively transferred in parallel into cells 37, 47, 57, . . . 87, by proper application of an S signal on input line 30, which connects to conductor 32. This signal interacts with the B′ signal to provide a parallel shifting of all cells 36, 46, . . . 86 into the vertical gas channels, such as channel 25. Subsequent application of timed voltages amongst the A, B, and S conductors propagate the cell conditions in parallel along all of the vertical channels. A sequence of electrical signals which may be used to control the energization of the respective conductors is shown in FIG. 4, wherein it is seen that a cyclical pattern of voltages having a period T is sufficient to repetitively control the display pattern which appears across the face of the display panel.

Figure 3:
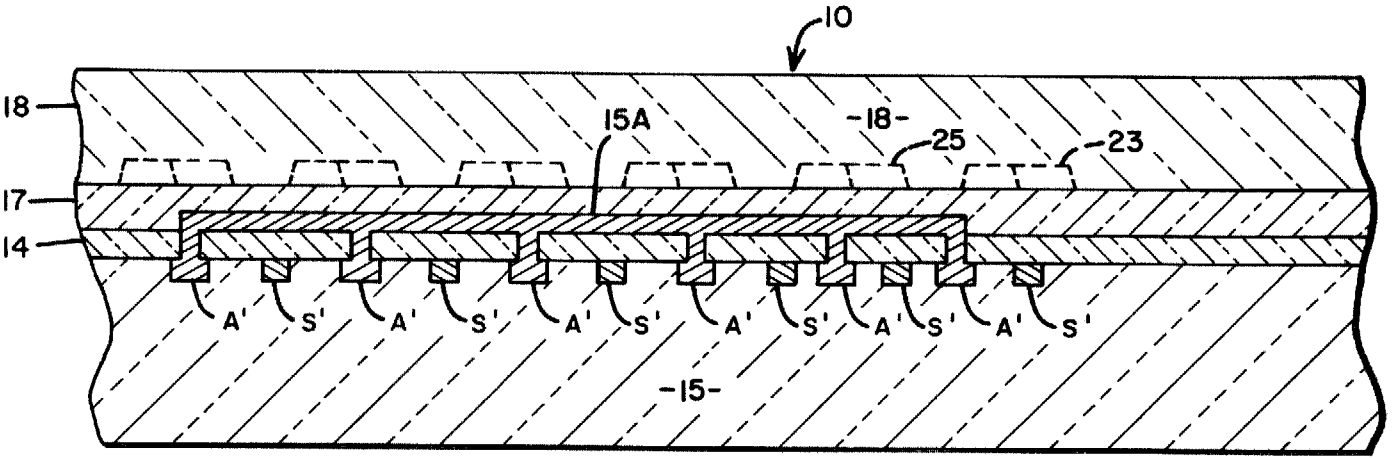
FIG. 3 is a sectional view taken along the lines 3—3 of FIG. 2.

FIG. 3 shows a cross-sectional view of display panel 10 taken along the lines 3—3 of FIG. 2. A lower glass plate 15 has a plurality of conductors or conductor segments embedded therein. A thin glass layer 14 overlays most of the conductor segments, although the A′ conductors shown in FIG. 3 have raised conductive posts which project through layer 14 to transverse conductor 15A. A glass layer 17 overlays layer 14 and the remaining conductors and conductor posts which project through layer 14. Overlaying layer 17 and tightly sealed thereto is upper glass plate 18. Glass plate 18 has a plurality of channels etched along its lower surface, which channels generally run into the drawing as shown in FIG. 3, as for example channels 23 and 25. A detailed description of dimensions and relative spacing of channels, as well as the thickness of the glass dielectric layers of this type of construction is provided in my copending Application Ser. No. 112,103, filed Jan. 14, 1980, which description is generally applicable to the present invention.

Figure 4:
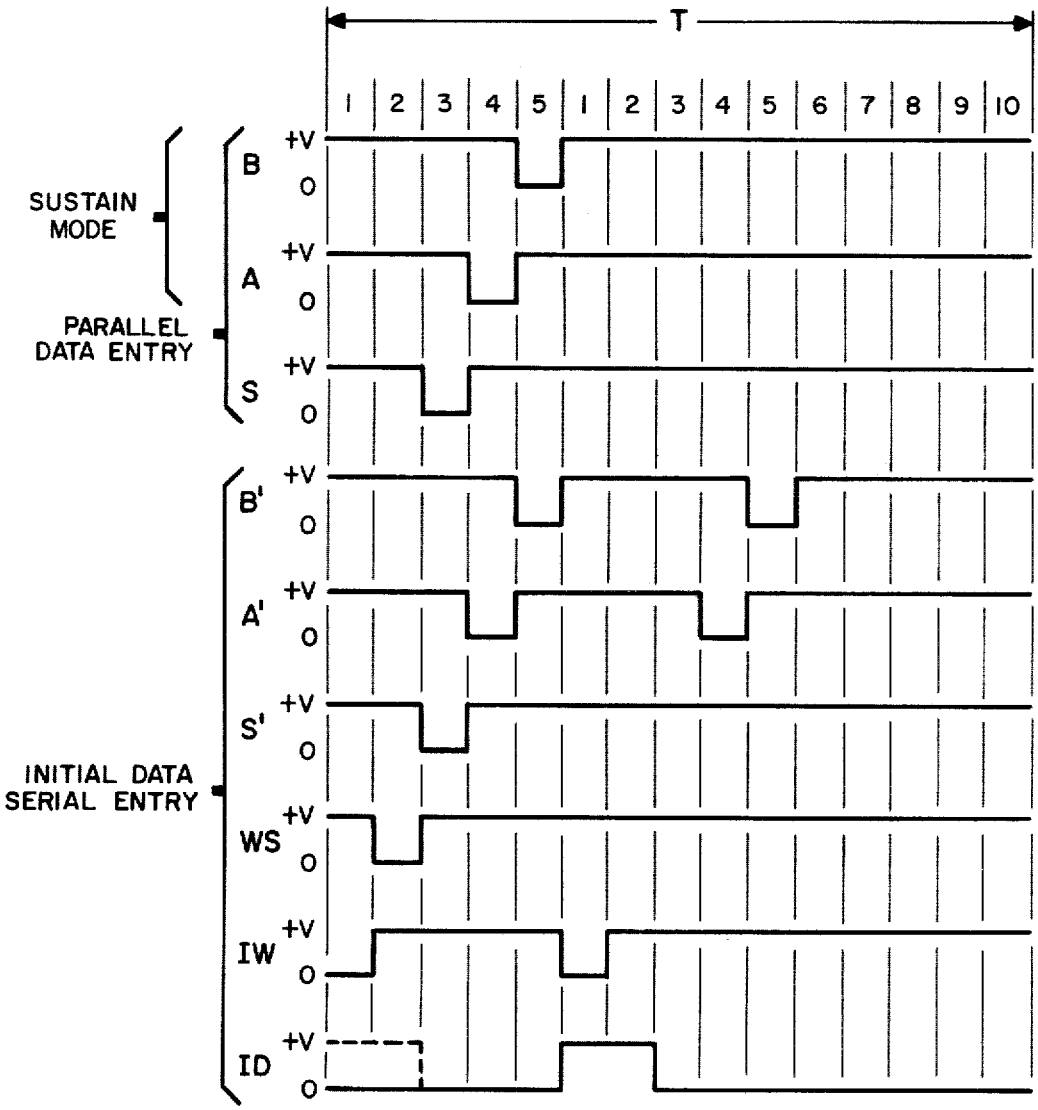
FIG. 4 shows a timing diagram for energizing the electrical conductors of the invention.

FIG. 4 shows a timing diagram of the various electrical signals which may be applied to the conductors described hereinbefore. These signals are repetitively applied over period T, for the purpose of transferring display information into the panel. When information is not being transferred into the panel, but is merely being constantly displayed in the panel, only the A and B signals are generated on a repetitive basis. The A and B signals cause repeated voltage polarity reversals between adjacent conductors, thereby repeatedly igniting the gas in the cell space between such conductors, if gaseous ignition were present between the same conductors at the time the A and B cyclical voltages are applied. If no gaseous ignition occurred initially between adjacent A and B conductors the repetitive application of A and B signals will not cause ignition nor perpetuate it. The repetition of the A and B signals are sometimes referred to as "sustain" signals, for their function is to sustain whatever gaseous ignition state existed at the time of their initial application.

An alternative and preferred sequence of electical signals and method of driving a display panel of the general type disclosed herein is described in U.S. Pat. No. 4,176,298, issued Nov. 27, 1979 and entitled "Display Panel Apparatus and Method of Driving".

In operation, the drive signals are applied in either one or two modes of operation. In the "sustain" mode of operation only the "A" and "B" signals are continuously and repetitively applied. As stated hereinbefore, these signals serve to sustain cells which have been previously ignited between adjacent "A" and "B" conductors in a repetitive on-off ignition state. While these cells are repeatedly turned on and off in this mode, they appear to be in constant ignition to the viewer, and the display therefore appears to be a solid and stable luminous display of whatever information is presented on the gas display panel. The application of these signals in this mode of operation can recur indefinitely, providing a constant display of information for the viewer.

The second mode of operation is utilized to enter new information into the display panel. This mode of operation utilizes all of the signals represented on FIG. 4 according to a 2-step format. Initially a number of serial bits of information are received on the $I_D$ line and are propagated in the form of ignition and nonignition of cells through channel 23 according to the timing sequence labeled "initial data serial entry" until the serial combination of signals has been shifted across the number of parallel gas channels into position adjacent the ends of the respective gas channels. At this point the B′ and S conductors are activated to cause the cell condition at the respective ends of each of the channels to move into the gas channels, according to the timing sequence labeled "parallel data entry," while at the same time continuing the serial inputting of information at the $I_D$ line. The first parallel sequence of signals may be sustained between A and B conductors, according to the timing sequence labeled "sustain mode," while a new serial set of signals is shifted across channel 23 into position adjacent the ends of the respective channels, and this new information together with the parallel information previously sustained is moved in parallel into the channels. This operation is repeated for each new series-connected string of input data until all the channels are progressively filled according to the desired combination of signals, at which time the "sustain mode" of operation is again initiated to maintain the image displayed.

Figure 5A:
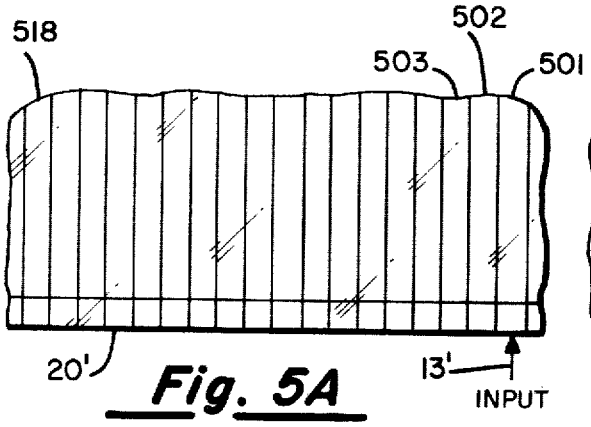
FIGS. 5A–5H show a symbolic representation of an alternative embodiment of the invention and method of operating same.

FIGS. 1–3 illustrate a gas display panel having 6 elongated, parallel gas channels which may be made of any preferable length. This embodiment of display panel therefore produces a dot matrix display which has six dots in the narrow dimension and any predetermined number of dots in the long dimension, and the dot matrix is capable of displaying any pattern of images, consistent with the size and revolution of the matrix. Alternative forms of dot matrix display panels embodying the general principles of the present invention are equally feasible. Such panels may be either rectangular or square in overall dimensions, may have their long dimensions placed either horizontally or vertically, and may even consist of a plurality of separate display panels arranged in a side by side configuration to create an overall display image in sections. FIGS. 5A–5H illustrate symbolically an alternative embodiment of display panel, together with a method for displaying images on such a panel. FIG. 5A shows a symbolic representation of a portion of an alternative embodiment, wherein the end region 20′ is representative of and functionally equivalent to region 20 of FIG. 1. Region 20′ represents the portion of the display panel of the present invention in which serial shifting of the gaseous ignition cells is accomplished, with a serial input signal being shown at 13′. A plurality of parallel, elongated gas channels are symbolically shown as channels 501, 502, 503, . . . 518. For purposes of simplicity the various conductor segments associated with such a panel and described herein are eliminated from FIGS. 5A–5H.

For purposes of illustration, FIG. 5A represents a portion of a display panel comprising a dot matrix display panel wherein no images are presently displayed.

Figure 5E:
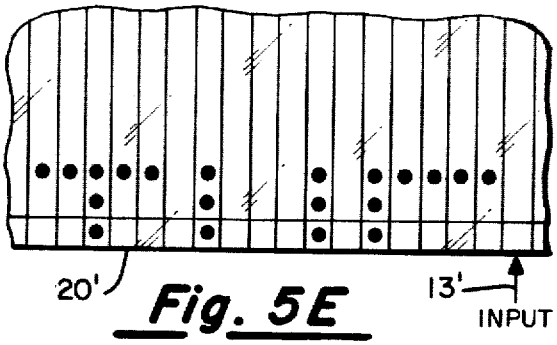
Figure 5B:
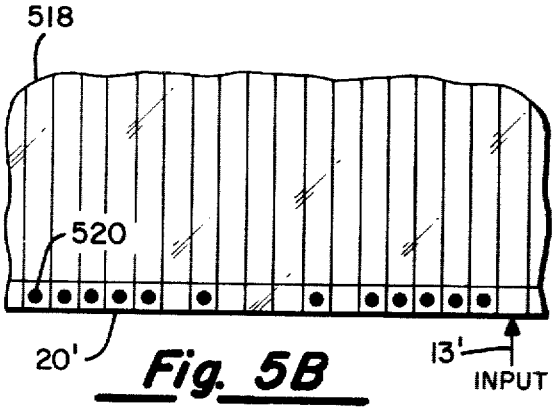

Subsequent FIGS. (5B–5H) illustrate the process in which images of any form may be introduced into the panel and displayed as a dot matrix. The following example shows the progressive shifting pattern which occurs when the word THE is displayed on the panel. In FIG. 5B, a plurality of gaseous ignition cells has been serially input into the end region 20' of the panel and shifted thereacross until the first gaseous ignition cell 520 is located adjacent the end of channel 518. Other gaseous ignition cells are serially shifted through region 20' to reside adjacent the ends of the channels as shown in FIG. 5B. All of such shifting is accomplished according to the application of voltages to the conductors described hereinbefore.

Figure 5F:
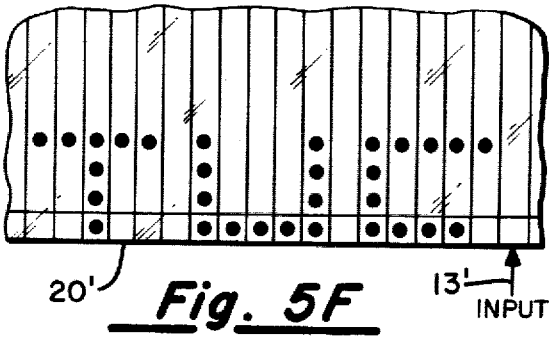
Figure 5C:
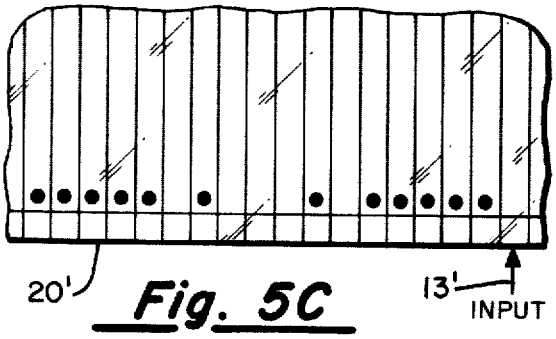
Figure 5G:
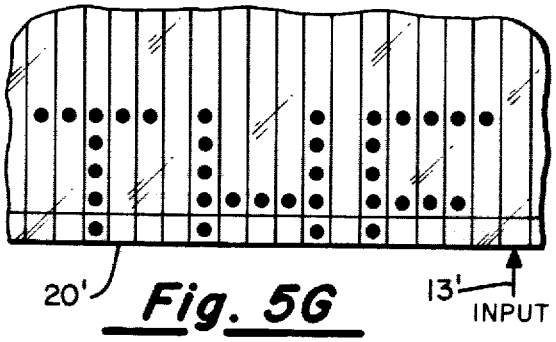
Figure 5D:
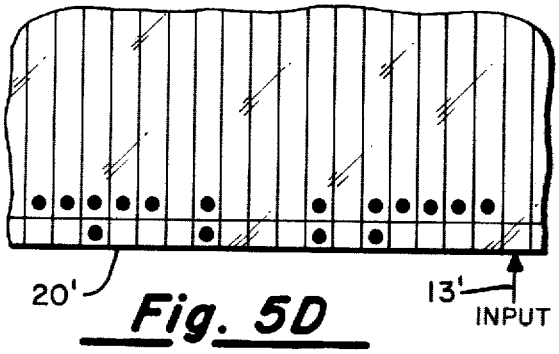
Figure 5H:
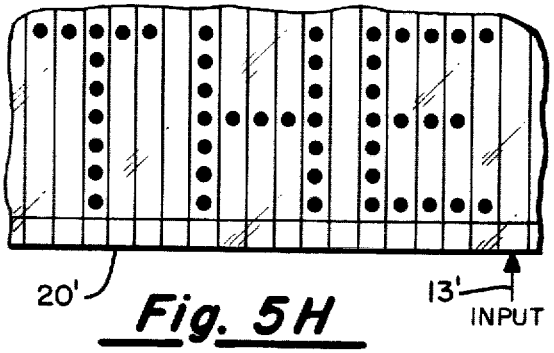

FIG. 5C shows the parallel transfer of all ignited gaseous ignition cells into the respective channels with which they have been prepositioned, such parallel transfer being accomplished by proper voltage excitation of the B', S, A, B signals hereinbefore described. At the completion of this step all of the cell regions in 20' are extinguished and new serial input data is again applied to input 13'. FIG. 5D illustrates the conclusion of the serial shifting of a subsequent pattern of gaseous ignition cells through region 20' to preselected positions adjacent the channels. While this subsequent serial shifting action is occurring, the first pattern of gaseous ignition cells are held stationary in their respective channel positions by the "sustain" mode of operation previously described. At the conclusion of this step the gaseous ignition cells in region 20 are again moved into the adjacent ends of the channels, while at the same time the gaseous ignition cells previously occupying the adjacent channel positions is stepped along one cell position, utilizing the same signals and circuitry as was described with relation to FIG. 5C. Again, as before, after the parallel shifting has occurred all of the cells in region 20' are extinguished and ready to accept the next subsequent serial shift pattern from input 13'. This step is shown in FIG. 5E, wherein a subsequent pattern of gaseous ignition cells has been positioned adjacent the ends of the channels, and wherein the previously ignited cells have been moved in parallel along the channels as shown. FIG. 5F shows the next subsequent series of steps wherein a new serial pattern of gaseous ignition cells resides in region 20', and all previous gaseous ignition cells have been parallel-shifted along the channels. Similarly, FIG. 5G shows the next subsequent series of steps, wherein the dot matrix display is controlled to develop the letters THE on a repetitive, step by step basis. FIG. 5H shows the final series of steps necessary to create the word THE, wherein all relevant gaseous ignition cells are properly positioned within the respective channels. The displayed word THE may be subsequently moved upwardly along the gas channels in a parallel shifting format to any desired display position on the panel. In a practical display panel this effect appears as a "scrolling effect" wherein an entire line of characters moves upwardly in parallel.

A display panel of the type symbolically illustrated in FIGS. 5A–5H may be electrically coupled to a typewriter or other alphanumeric inputting device to create a visual display of the alphanumeric information as it is being developed by the device. This embodiment is particularly useful in word processing systems of the type commonly used in commercial business practice.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for displaying information in dot matrix form through the combined and selected ignition of gaseous regions in a panel having a plurality of gas-filled channels and voltage-energized conductors associated therewith, comprising (a) a predetermined number of gas channels in parallel alignment in said panel;

(b) an orthogonal gas channel positioned adjacent one end of all of said parallel channels and opening into said parallel channels;

(c) means for selectively and serially shifting one or more gaseous ignition regions along said orthogonal gas channel; and (d) means for parallel shifting all of said serially-shifted gaseous ignition regions into and along said parallel gas channels.

2. The apparatus of claim 1, wherein said means for selectively and serially shifting further comprises a plurality of conductor segments adjacent to said channel but in dielectric separation therefrom.

3. The apparatus of claim 1, wherein said means for parallel shifting further comprises a plurality of conductor segments adjacent to said parallel gas channels but in dielectric separation therefrom.

4. The apparatus of claim 2, wherein said conductor segments are spaced along said channel in substantially equal spacings.

5. The apparatus of claim 3, wherein said conductor segments are spaced along the length of said parallel gas channels in substantially equal spacings.

6. The apparatus of claim 4, wherein the respective conductor segment cross-sectional areas facing said channel are substantially equal, one to another.

7. The apparatus of claim 5, wherein the respective conductor segment cross-sectional areas facing said channels are substantially equal, one to another.

8. The apparatus of claim 1, wherein the width of said orthogonal gas channel is substantially equal to the widths of the respective parallel channel ends into which said orthogonal channel opens.

9. The apparatus of claim 8, wherein said parallel gas channels further comprise a narrowed end region connecting said orthogonal channel.

10. In a gas display panel of the type comprising a plurality of glass layers and having conductors embedded therein and parallel gas channels orthogonally adjacent to and in dielectric separation from said conductors, the improvement comprising a further gas channel positioned adjacent the ends of said parallel gas channels and orthogonal thereto, each of said parallel gas channels opening into said further gas channel.

11. The improvement of claim 10, further comprising a plurality of conductor segments in spaced relation and bridging said further gas channel and in dielectric separation therefrom.

12. The apparatus of claim 11, wherein said parallel gas channels have narrowed end regions at the point of opening into said further gas channel.

13. The apparatus of claim 12, wherein said conductor segments are substantially equally spaced and of substantially equal cross-sectional area.

14. The apparatus of claim 13, further comprising an input conductor positioned at an end of said further gas channel in dielectric separation therefrom.

15. A method of entering visual display information serially into a gas display dot matrix panel and for forming therefrom an image in parallel, comprising the steps of:

(a) serially transferring a dot matrix segment corresponding to a line portion of said image into a line position adjacent the end of said panel;

(b) parallel transferring said dot matrix segment into a first line position in said panel;

(c) serially transferring a dot matrix segment corresponding to a further line portion of said image into said line position adjacent the end of said panel;

(d) parallel transferring said further line dot matrix segment and said previous line dot matrix segment respectively into a first and second line position in said panel;

(e) repeating steps (c) and (d) for all subsequent line portions of said image; wherein step (d) further comprises parallel transferring all previous line dot matrix segments respectively into one further line position in said panel.

* * * * *